US006978912B2

(12) United States Patent
Taylor et al.

(10) Patent No.: US 6,978,912 B2
(45) Date of Patent: Dec. 27, 2005

(54) HEATED DISPENSER

(75) Inventors: Roy Harold Taylor, Stratford, CT (US); Vito J. Carlucci, Stratford, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/633,370

(22) Filed: Aug. 1, 2003

(65) Prior Publication Data

US 2004/0065683 A1 Apr. 8, 2004

Related U.S. Application Data

(60) Provisional application No. 60/400,743, filed on Aug. 2, 2002.

(51) Int. Cl.[7] ..... B67D 5/62

(52) U.S. Cl. ..... 222/146.3; 222/146.5; 222/402.13

(58) Field of Search ..... 222/146.2, 146.3, 222/146.5, 402.1, 402.13

(56) References Cited

U.S. PATENT DOCUMENTS

| | | | | |
|---|---|---|---|---|
| 2,060,440 | A | 3/1936 | Rosenbald | 257/245 |
| 2,736,533 | A | 2/1956 | Allen | 257/241 |
| 3,338,476 | A | 8/1967 | Marcoux | 222/146 |
| 3,476,293 | A | 11/1969 | Marcoux | 222/146 |
| 3,518,410 | A | 6/1970 | Dillarstone | 219/300 |
| 3,578,945 | A | 5/1971 | Ayres | 219/214 |
| 3,588,467 | A | 6/1971 | Grosjean | 219/214 |
| 3,710,985 | A | 1/1973 | Baum | 22/146 |
| 3,749,880 | A | 7/1973 | Meeks | 219/214 |
| 3,790,033 | A | 2/1974 | Ciaffone | 222/146 |
| 3,891,827 | A | 6/1975 | Wyse | 219/302 |
| 3,990,612 | A | 11/1976 | Gasser | 222/146 |
| 4,000,834 | A | 1/1977 | Whitley | 222/180 |
| 4,027,786 | A | 6/1977 | Ryckman, Jr. | 222/146 |
| 4,056,707 | A | 11/1977 | Farnam | 219/302 |
| 4,067,480 | A | 1/1978 | Gasser | 222/146 |
| 4,263,498 | A | 4/1981 | Meyers | 219/312 |
| 4,274,588 | A | 6/1981 | Schwob | 239/138 |
| 4,544,085 | A | 10/1985 | Frazer | 222/146.4 |
| 4,782,212 | A | 11/1988 | Bakke | 219/299 |
| 4,847,470 | A | 7/1989 | Bakke | 219/299 |
| 5,040,700 | A | 8/1991 | Compton | 222/146.5 |
| 5,111,969 | A | 5/1992 | Knepler | 222/54 |
| 5,573,666 | A | 11/1996 | Korin | 210/232 |
| 6,056,160 | A | 5/2000 | Carlucci et al. | 222/146.3 |
| D426,413 | S | 6/2000 | Kreitemier et al. | D6/543 |
| 6,101,835 | A | 8/2000 | Butsch et al. | 62/390 |
| 6,216,911 | B1 | 4/2001 | Kreitmier et al. | 222/1 |
| 6,415,957 | B1 | 7/2002 | Michaels et al. | 222/146.3 |
| 2002/0074349 | A1 * | 6/2002 | Michaels et al. | 222/146.3 |
| 2004/0226966 | A1 * | 11/2004 | Carlucci et al. | 222/146.5 |

FOREIGN PATENT DOCUMENTS

| | | |
|---|---|---|
| WO | WO 99/51974 | 10/1999 |

* cited by examiner

*Primary Examiner*—Joseph A. Kaufman
(74) *Attorney, Agent, or Firm*—Ohlandt, Greeley, Ruggiero & Pearle, L.L.P.

(57) ABSTRACT

A dispenser is provided that heats and dispenses a gel or lotion prior to the gel turning into lather. The dispenser can be selectively engaged with different sized and/or shaped cans.

10 Claims, 15 Drawing Sheets

HEATED DISPENSER

RELATED APPLICATION

This application is related to and claims priority in, co-pending U.S. Provisional Application Ser. No. 60/400,743, filed Aug. 2, 2002, the disclosure of which is incorporated herein by reference.

BACKGROUND OF THE INVENTION

1. Field of the Invention

The present invention relates to dispensers. More particularly, the present invention relates to a heated gel or lotion dispenser.

2. Description of the Prior Art

Dispensable gels or lotion are used for a variety of applications, such as shaving gels for application to the face. It is often desirable to heat the gels to improve comfort for the user. For shaving that uses a gel that turns into foam or lather upon application to the face, it is desirable to heat the gel prior to application. However, the heating of the gel causes the gel to begin to expand and turn into lather.

The present invention relates to a device and method for heating gel prior to application by the user.

SUMMARY OF THE INVENTION

It is an object of the present invention to provide a dispenser that dispenses heated gel.

It is another object of the present invention to provide such a dispenser that heats the gel without allowing it to turn into lather.

It is still another object of the present invention to provide such a dispenser that prevents dispensing of a cold shot of gel.

It is yet another object of the present invention to provide such a dispenser that reduces heating time and improves energy efficiency.

These and other objects and advantages of the present invention are achieved by a dispenser that heats and dispenses a gel prior to the gel turning into lather. The dispenser has a heating chamber with a first valve at the exhaust of the chamber and a second valve in fluid communication with the intake of the chamber. A user can open the exhaust and intake valves to allow gel to flow into the heating chamber and close the exhaust and intake valves so that the heating chamber becomes a closed system. The closed system prevents the gel from expanding when heat energy is transferred to the gel by a heater that is in thermal communication with the chamber. The dispenser can have a heating wire that is in thermal contact with the heating chamber. The heating wire can be wrapped around the heating chamber in a helical shape.

The present invention is provided by an apparatus for heating and dispensing a gel from any one of a plurality of cans having different sized stems. The apparatus has a housing, a coupling assembly, a heater assembly, and an intake assembly. The housing has a recess therein. The coupling assembly selectively engages with each of the plurality of cans for disposing at least a portion of each of the plurality of cans in the recess. The heater assembly has a heater and a heating chamber in thermal communication with the heater. The intake assembly is in fluid communication with the heating chamber. The intake assembly is selectively movable to engage with the different sized stems of the plurality of cans for supplying the gel to the heating chamber.

The present invention is provided by an apparatus for heating and dispensing a gel from a can having a stem. The apparatus has a housing, a coupling assembly, a heater assembly and an intake assembly. The housing has a recess therein. The coupling assembly is selectively engageable with the can to dispose at least a portion of the can in the recess. The heater assembly has a heater, a heat sink and a heating chamber formed in the heat sink. The heating chamber is in thermal communication with the heater. The intake assembly is operably connected to the housing and in fluid communication with both the heating chamber and the stem of the can when the can and housing are assembled, for supplying the gel to the heating chamber.

The present invention is provided by a system for heating and dispensing a gel. The system has a housing with a recess, a coupling assembly, an intake assembly and a heater assembly. The intake assembly is in fluid communication with the heater assembly. The system also has a can with a stem and top, middle and bottom portions. The can contains gel under pressure. The stem is disposed on the top portion. The coupling assembly selectively engages the top portion of the can in the recess and selectively engages the intake assembly with the stem to supply the gel to the heater assembly.

The housing can have an upper portion and a lower portion, and the recess can be formed in the lower portion. The lower portion can be selectively movable with respect to the upper portion. The upper portion can have a substantially elongated shape. The lower portion can have a substantially circular shape. The coupling assembly can have a movable fastener that selectively engages with each of the plurality of cans. The movable fastener can be a circumferential flange disposed about a periphery of the recess.

The heater assembly can include a heat sink, and the heating chamber can be formed in the heat sink. The heating chamber can be a channel having a non-linear shape. The heat sink can have a first portion, with the heater being disposed adjacent to the first portion, and the heating chamber being substantially disposed in the first portion.

The present invention also provides for an actuator and an exhaust valve. The exhaust valve can be in selective fluid communication with the heating chamber. Depressing the actuator can cause gel disposed in the heating chamber to dispense through the exhaust valve. The heating chamber can have a maximum volume, and actuating the actuator can cause a volume of gel substantially equal to the maximum volume to be dispensed through the exhaust valve. The middle and bottom portions of the can may be outside of the recess and accessible to the user.

DETAILED DESCRIPTION OF THE INVENTION

Figure 1:
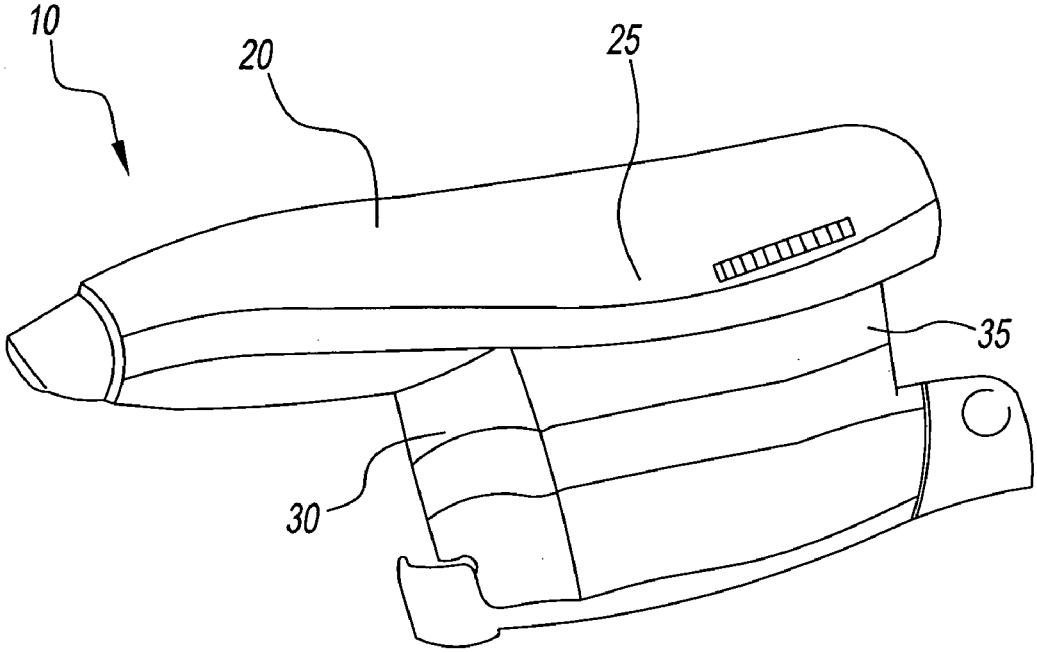
FIG. 1 is a side perspective view of a dispenser of the present invention.
Figure 2:
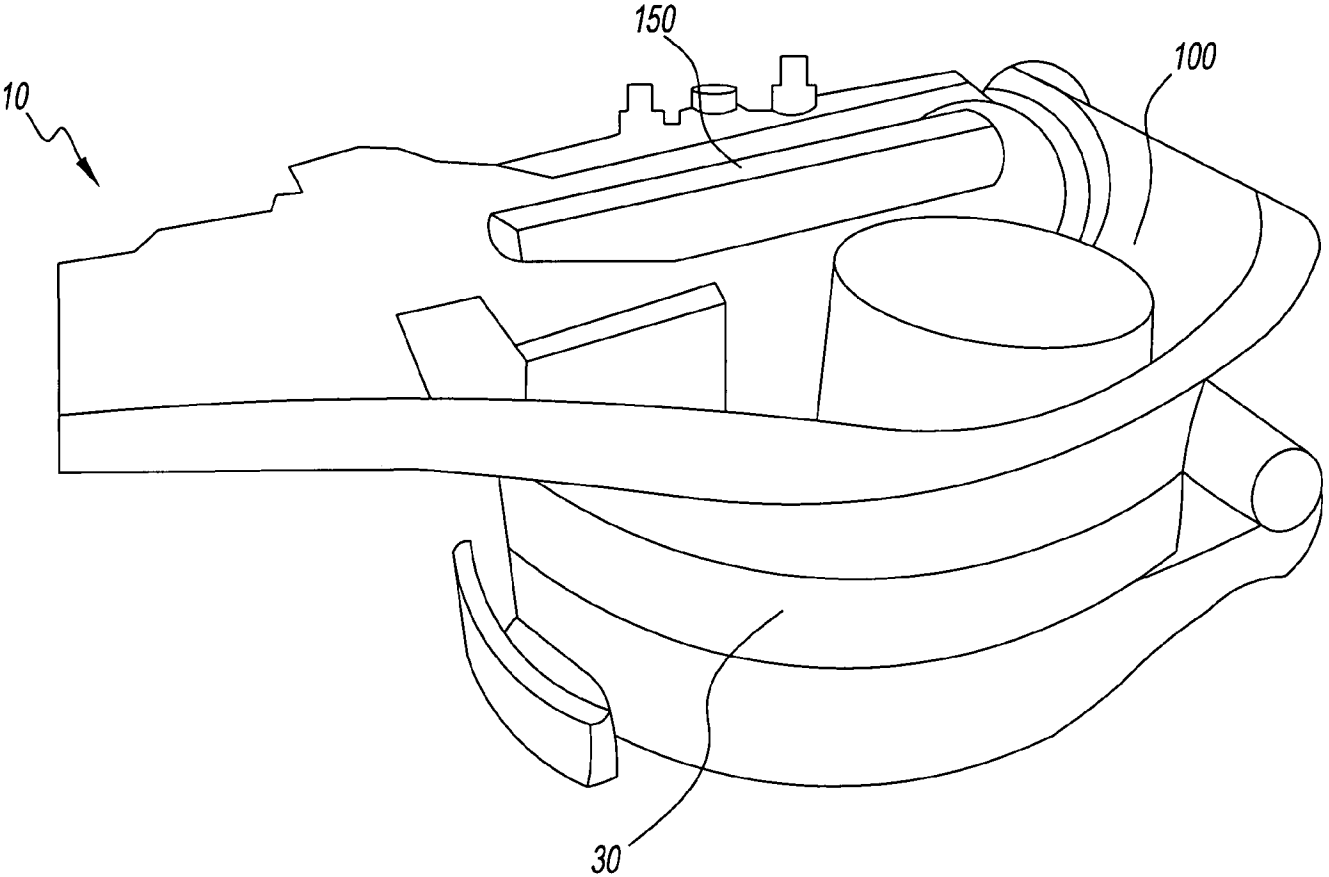
FIG. 2 is a top perspective view of the dispenser of FIG. 1 with the top removed.
Figure 3:
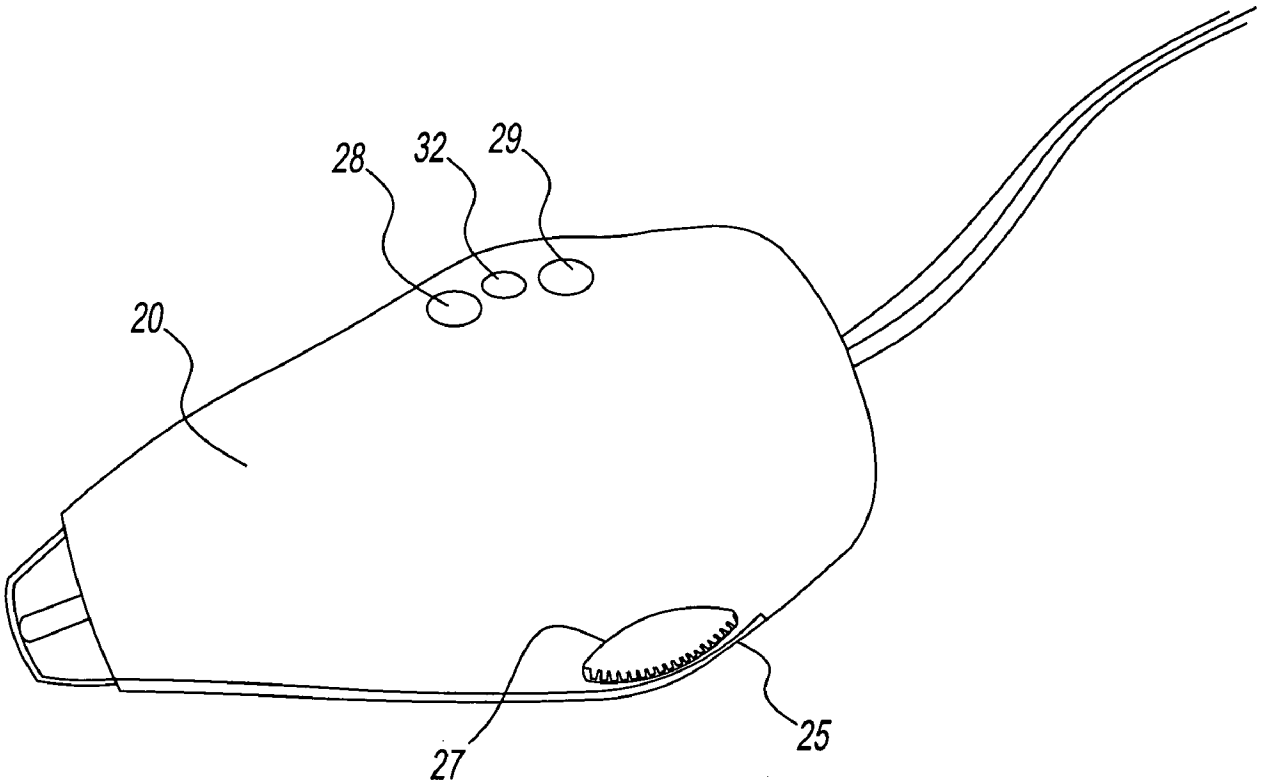
FIG. 3 is a top perspective view of the dispenser of FIG. 1.
Figure 4:
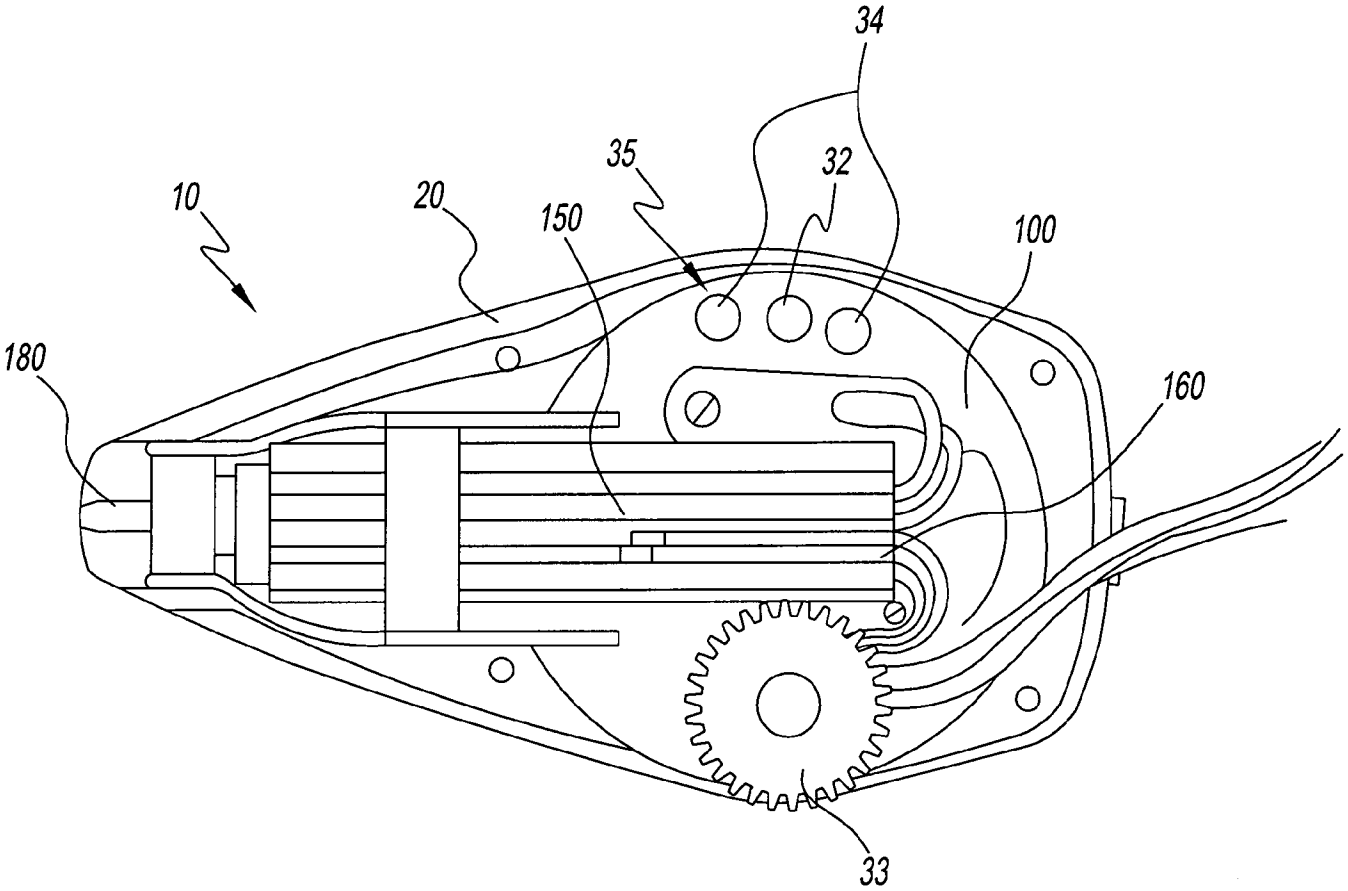
FIG. 4 is a top view of the dispenser of FIG. 1 with the top removed.
Figure 5:
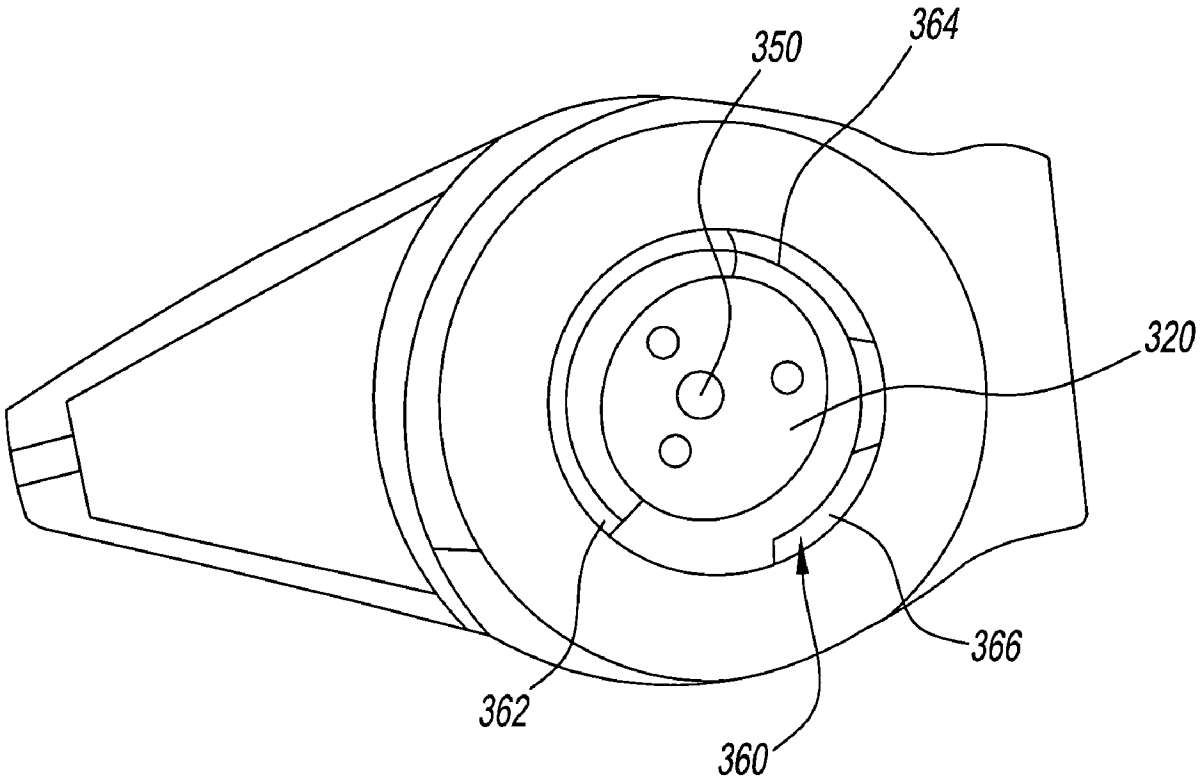
FIG. 5 is a bottom view of the dispenser of FIG. 1.

Referring to the drawings and in particular FIGS. 1 through 4, there is provided a dispenser generally represented by reference numeral 10. Dispenser 10 has a top 20 and a housing 30. Top 20 is connected to housing 30 to allow selective access to the inside of the housing, which contains other components of dispenser 10.

Top 20 preferably has an elongated shape that provides a point of dispensing of the gel or lotion remote from the gel-dispensing can. Additionally, the elongated shape of top 20 provides additional leverage to facilitate depressing of the top to actuate the gel-dispensing can, as will be discussed later in detail. The center portion 25 of top 20 and the center portion 35 of housing 30 are substantially circular for connection to the top of a gel-dispensing can. However, alternative shapes may be used for dispenser 10. Top 20 has control slots 27, 28 and 29 to provide for access to temperature control 33 and on/off controls 34, which are disposed on housing 30.

Referring to FIGS. 4 through 8, housing 30 has an upper portion 100, a middle portion 200, and a bottom portion 300. Upper portion 100, middle portion 200, and bottom portion 300 are secured together to form housing 30. Upper portion 100 and middle portion 200 are preferably pivotally secured to lower portion 300 by pivot 110. Pivot 110 is preferably positioned at the rear of dispenser 10 on the opposite side from the point of dispensing. The pivotal engagement of upper and middle portions 100, 200 with lower portion 300 provides for a rocker mechanism that allows for actuation of the gel-dispensing can. Although this embodiment uses a rocker mechanism, alternative structures and methods can be used for actuating the gel-dispensing can such as a vertical stacking arrangement of upper, middle and lower portions 100, 200, 300, respectively, so that the direction of depression is along the center line of dispenser 10.

Upper portion 100 mates with top 20 along the periphery of the upper portion and the top. Upper portion 100 preferably has an elongated, flat shape. Upper portion 100 preferably has, or is connected with, a heating chamber 150, a heater 160, an exhaust valve 170 and a dispensing or exhaust spout 180.

Heating chamber 150 is a hollow tube or cylinder having a first end 152 in proximity to exhaust spout 180 and a second end 154 remote from the exhaust spout. Heating chamber 150 is disposed longitudinally along the center-line of the upper portion. However, alternative shapes can also be used for heating chamber 150 including rectangular shapes, as well as non-uniform shapes. Also heating chamber 150 can be chambers have channels formed therein such as a tubular member having a helical channel formed along the outer surface of the tubular member. Additionally, alternative positioning of heating chamber 150 within upper portion 100 can also be used.

Heating chamber 150 is in thermal communication with heater 160. In this embodiment, heater 160 has a heating wire 165 that is in thermal contact with heating chamber 150. Heating wire 165 is wrapped around heating chamber 150 in a helical shape. Heating wire 165 is wrapped between first end 152 and second end 154 of heating chamber 150. By positioning heating wire 165 up to and including the first end 152 of heating chamber 150, dispenser 10 prevents the dispensing of a cold shot of gel contained in an unheated portion of the heating chamber.

Heating chamber 150 preferably has an inner volume 155 that is dimensioned to contain approximately or at least the amount of gel dispensed with a single actuation of top 20, as will be discussed later in detail. By providing for such a dimension of inner volume 155, a user will not dispense a cold shot of gel from outside of heating chamber 150. Additionally, by heating only the gel that is contained in heating chamber 150, dispenser 10 requires less thermal energy and less heat up time.

Heater 160 can be placed in alternative positions with respect to heating chamber 150 in order to provide the thermal energy necessary to heat the gel that will be contained in the heating chamber such as heating wire 165 running longitudinally along the heating chamber. Also, alternative arrangements and methods can be used to provide thermal energy to the gel in heating chamber 150 including the use of heat sinks.

Upper portion 100 of housing 30 has exhaust valve 170 adjacent to and sealingly connected with first end 152 of heating chamber 150. Exhaust valve 170 is adjacent to and in fluid communication with dispensing spout 180. Exhaust valve 170 is opened by the pressing down of top 20, which then permits the flow of gel out of heating chamber 150 through the exhaust valve and through dispensing spout 180 to the atmosphere. Exhaust valve 170 can be a standard aerosol valve or the like, which is known by one of ordinary skill in the art. In this embodiment, the opening of exhaust valve 170 is performed by a valve linkage 185.

Figure 7:
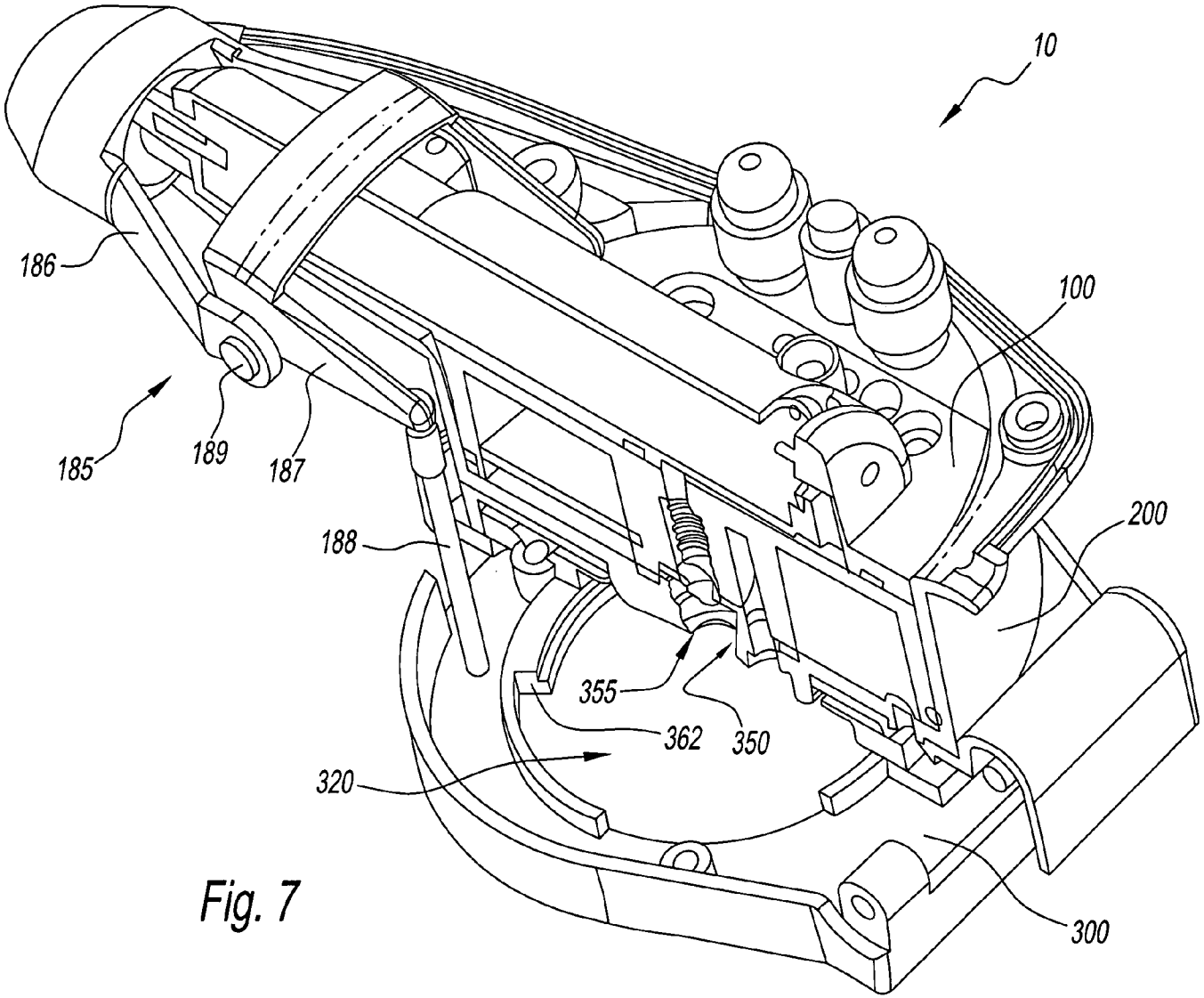
FIG. 7 is a top perspective view of the cross-section of FIG. 6.
Figure 8:
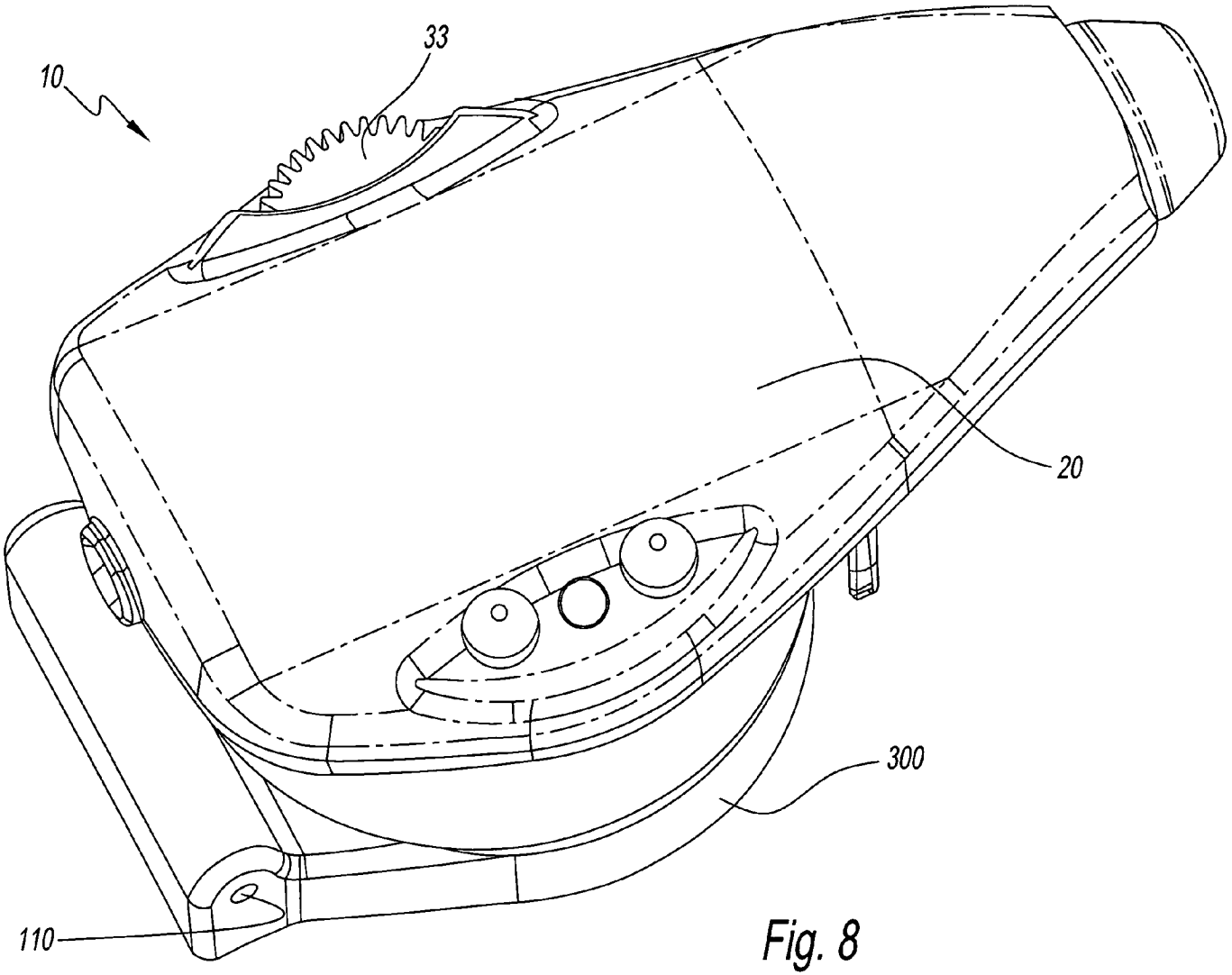
FIG. 8 is a rear perspective view of the dispenser of FIG. 1.

As shown in FIG. 7 (only one of each is shown), valve linkage 185 has a pair of upper members 186, a pair of middle members 187 and a pair of lower members 188. Upper members 186 are operably connected to exhaust valve 170 in order to move the exhaust valve in a direction toward heating chamber 150, which opens the exhaust valve. Each upper member 186 is pivotally connected to a separate middle member 187 at one of pivots 189 (one of which is shown). Each middle member 187 is connected to a different lower member 188. As the user pushes down on top 20, lower members 188 remain in contact with lower portion 300 of housing 30, causing middle members 187 to pivot upwardly about pivot 189. This pivotal movement causes upper members 186 to be moved inwardly toward lower portion 300 of housing 30, which causes exhaust valve 170 to open. While this embodiment uses a mechanical linkage to actuate exhaust valve 170, alternative linkage arrangements can also be used.

Figure 6:
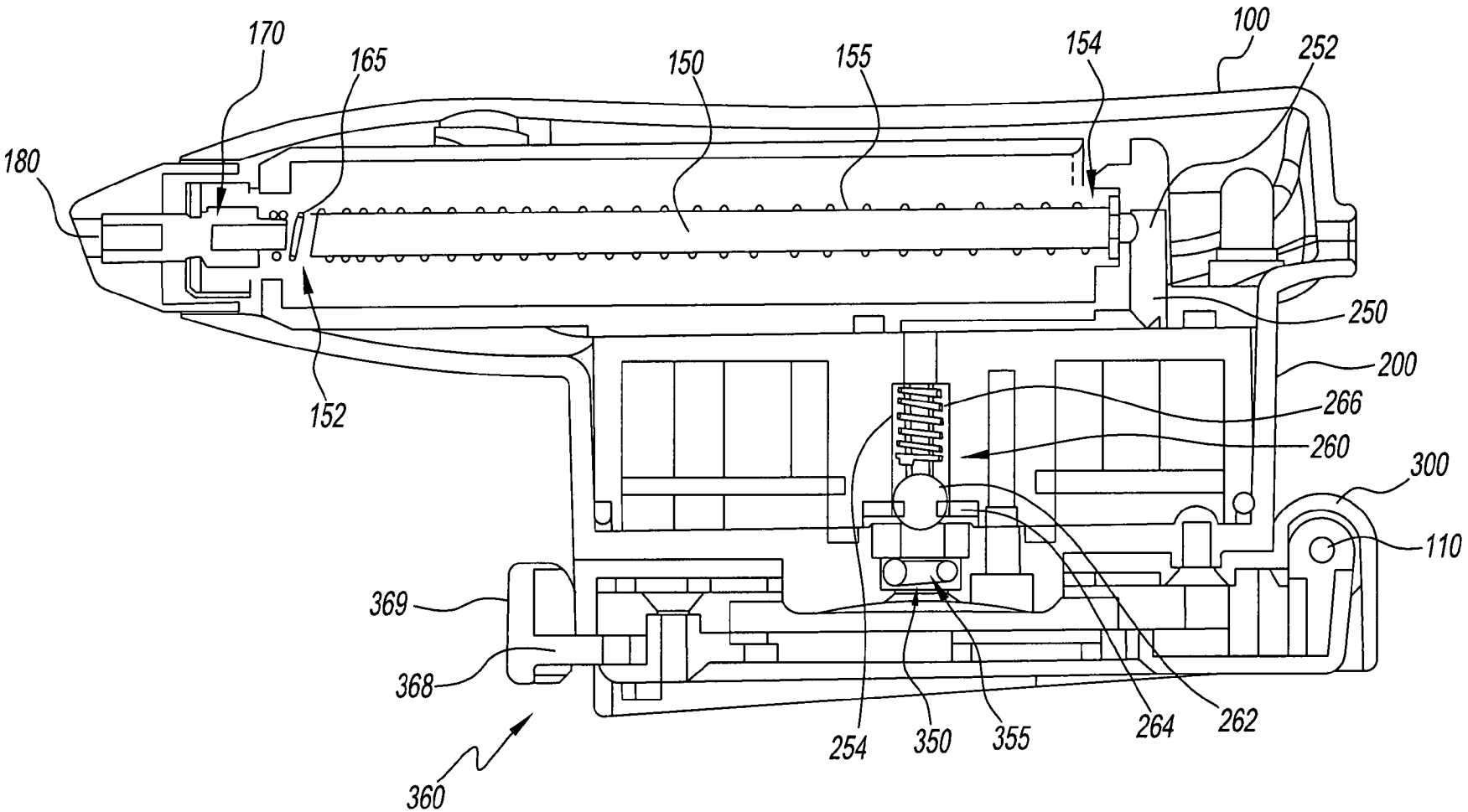
FIG. 6 is a cross-sectional view taken along line 6—6 of FIG. 3.

Upper portion 100 and middle portion 200 have a supply channel 250 shown in FIG. 6. Supply channel 250 has a first end 252 and a second end 254. First end 252 is disposed in upper portion 100 of housing 30 and is adjacent to, and in fluid communication with, second end 154 of heating chamber 150.

Second end 254 of supply channel 250 is disposed in middle portion 200 of housing 30. Second end 254 has an intake check valve 260. In this embodiment, check valve 260 is a ball valve assembly. The ball valve assembly 260 has a ball 262, a ball seat 264 and a biasing member, which is preferably a coil spring 266. Ball 262 sealingly engages with ball seat 264 and disengages with the ball seat when a pressure is applied to the ball that is greater than the resistance of spring 266. While in this embodiment, check valve assembly 260 is a ball valve 260, alternative check valve assemblies can be substituted for the ball valve, which allow flow of gel into supply channel 250 when a pressure greater than a predetermined amount, i.e., the resistance of biasing means or spring 266, is applied to the check valve. Check valve 260 prevents backflow of the gel out of supply channel 250.

Lower portion 300 of housing 30 has a cavity 320, an intake housing 350 and a fastening assembly 360. Cavity 320 is preferably circular and substantially centrally located in lower portion 300. Cavity 320 is dimensioned to fit around the top end of a gel-dispensing can so that the stem of the can be placed in intake housing 350.

Intake housing 350 is preferably adjacent to supply channel 250 through check valve 260. Intake housing 350 has an actuator surface 355. Actuator surface 355 abuts the dispensing stem of the gel-dispensing can (not shown) and pushes the stem downward to allow flow from the can through the stem of the can disposed in intake housing 350 through check valve 260 into supply channel 250 and into heating chamber 150. While this embodiment uses actuator surface 355 that allows for depressing of the gel-dispensing can stem, alternative structures and methods can also be used to actuate the gel-dispensing can to provide the gel to heating chamber 150.

Fastening assembly 360 has three securing tabs 362, 364, 366 positioned along the circumference of cavity 320. Securing tabs 362, 364, 366 are shaped and/or dimensioned to lock around the top end of a gel-dispensing can. Securing tabs 364, 366 are preferably secured to a slide bar 368 having a slide actuator 369. Securing tabs 364, 366 are biased towards securing tab 362 (biasing member not shown). By pushing slide actuator 369 towards securing tab 362, slide bar 368 moves securing tabs 364, 368 away from securing tab 362 and increases the area of cavity 320. Cavity 320 can then be positioned around the top end of the gel-dispensing can and the force of the biasing member secures securing tabs 362, 364, 366 to the can.

In operation, a user depresses top 20 towards the gel-dispensing can. The pivotal engagement of upper and middle potions 100, 200 provides a rocker mechanism that causes actuator surface 355 to depress the stem of the gel-dispensing can. The internal pressure of the gel-dispensing can is greater than the resistance of spring 266 of check valve 260, which causes gel to flow through the stem of the can in intake housing 350 through check valve 260 through supply channel 250 and into heating chamber 150. The downward pressing of top 20 also opens exhaust valve 170.

Once top 20 is released, exhaust valve 170 and the stem of the gel-dispensing can will be closed. This also causes ball 262 to sealingly engage with ball seat 264, and closes check valve 260 because the pressure on the ball is no longer greater than the resistance of spring 266.

Heating chamber 150 and supply channel 250 are a selectively closed system due to exhaust valve 170 and check valve 260. The gel that has entered supply channel 250 and heating chamber 150 is in a temporarily closed system because exhaust valve 170 and check valve 260 are closed. The closed system maintains pressure on the gel while the gel is being heated by heater 160. The temporarily closed system prevents the gel from expanding and turning into lather.

When the user desires to dispense the heated gel, top 20 is again depressed towards the gel-dispensing can causing exhaust valve 170 to open and also causing actuation of the gel-dispensing can. The heated gel is dispensed out of heating chamber 150 through dispensing spout 180 as a result of the internal pressure of the can and the flow of unheated gel from the can into supply channel 250 and the heating chamber. Check valve 260 also prevents backflow of gel from supply channel 250 when dispenser 10 is removed from the gel-dispensing can.

Dispenser 10 has or is connected to controls for temperature regulation and on/off, and a timed shut off switch. Dispenser 10 further includes a power indicator 32. In this embodiment, dispenser 10 has a ready LED 32 as the indicator. Dispenser 10 also includes dual voltage circuitry for supplying power to heater 160 so that the device can be utilized outside of the United States. Heater 160 also includes a temperature regulator and a safety sensor for overheating.

In this embodiment, dispenser 10 has a selectively sealable or closed system for heating the gel, which uses exhaust valve 170 and intake check valve 260 to selectively seal heating chamber 150 in order to prevent expansion of the gel. Check valve 260 further prevents backflow of the gel in the event that dispenser 10 is removed from the gel-dispensing can. Alternatively, a sealing engagement of heating chamber 150 with the stem of the gel-dispensing can would also create a selectively sealable system to heat the gel while preventing expansion. Such a sealing engagement could include a seal of intake housing 350 or supply channel 250 with the stem of the gel-dispensing can, or alternatively sealing dispenser 10 with the gel-dispensing can.

While this embodiment provides for dispenser 10 that can engage a gel-dispensing can of various dimensions, alternatively, dispenser 10 can have a pressurized gel container 10 that is connected to lower portion 300 of housing 30. In such an embodiment, alternative valves could be used rather than the stem as discussed above or check valve 260, in order to create a selectively sealable system for heating only a portion of the gel while maintaining pressure in the system to prevent expansion of the gel.

Figure 9:
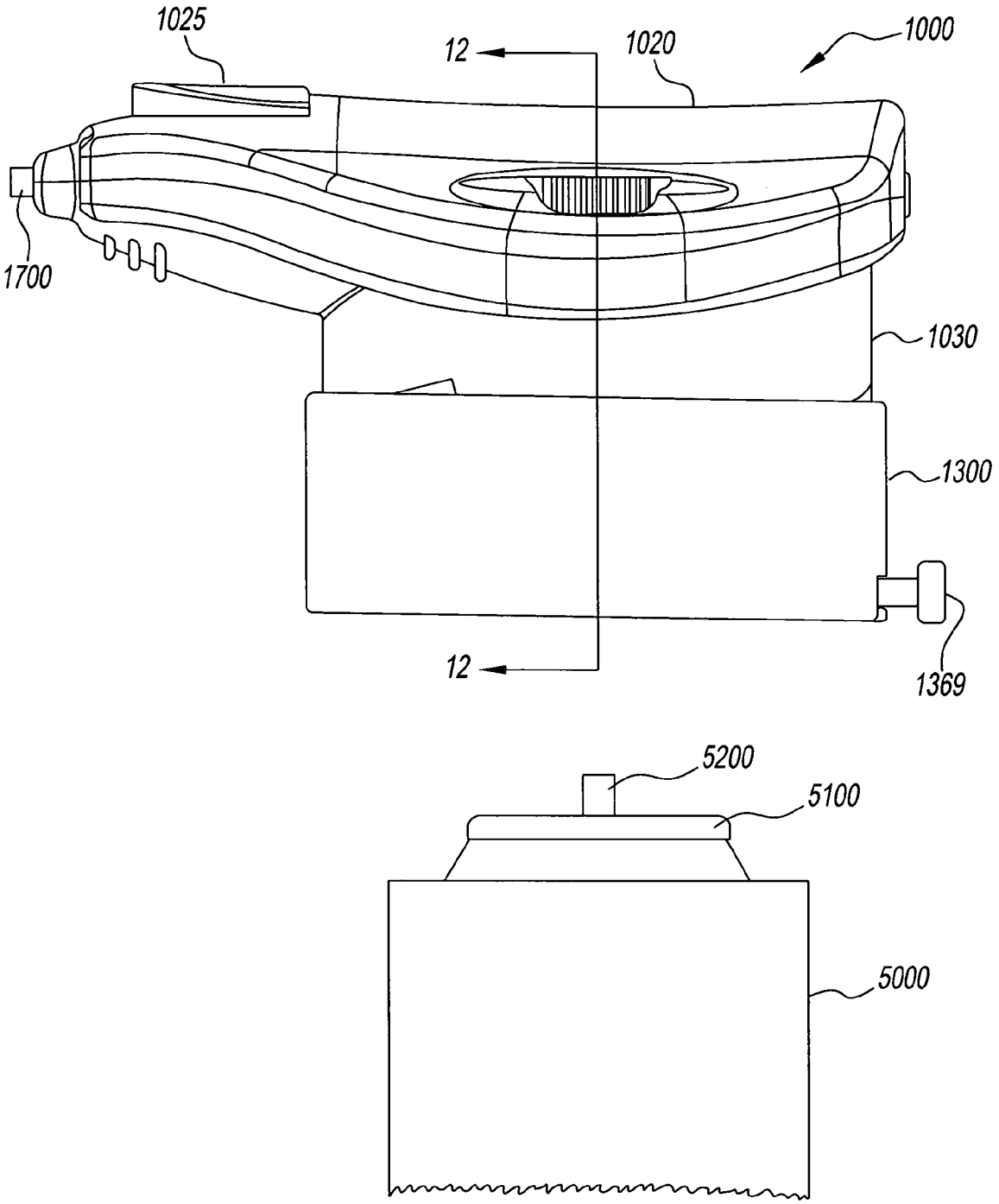
FIG. 9 is a side view of an alternative embodiment of the dispenser of the present invention with a top portion of a gel can.
Figure 10:
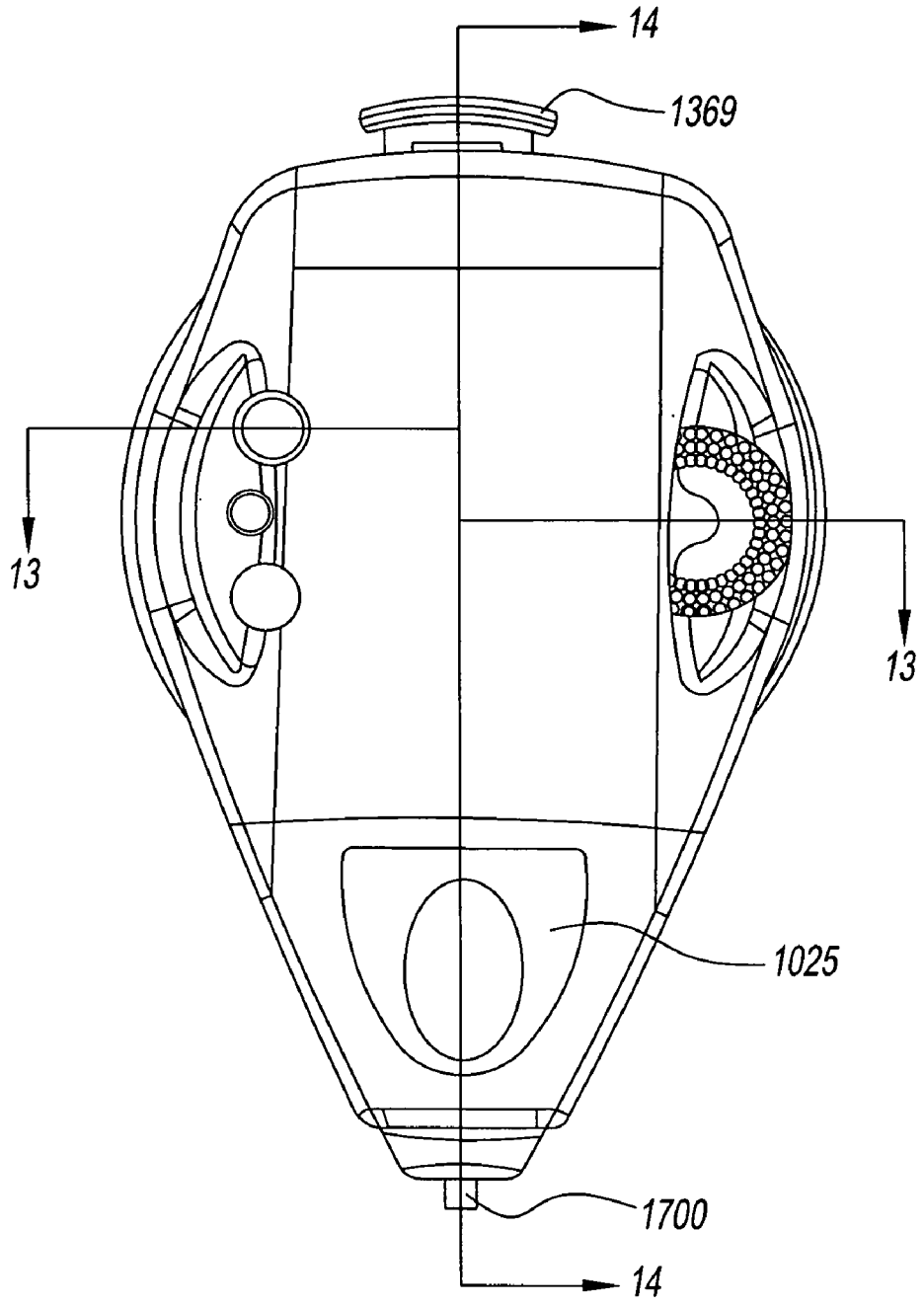
FIG. 10 is a top view of the dispenser of FIG. 9.
Figure 11:
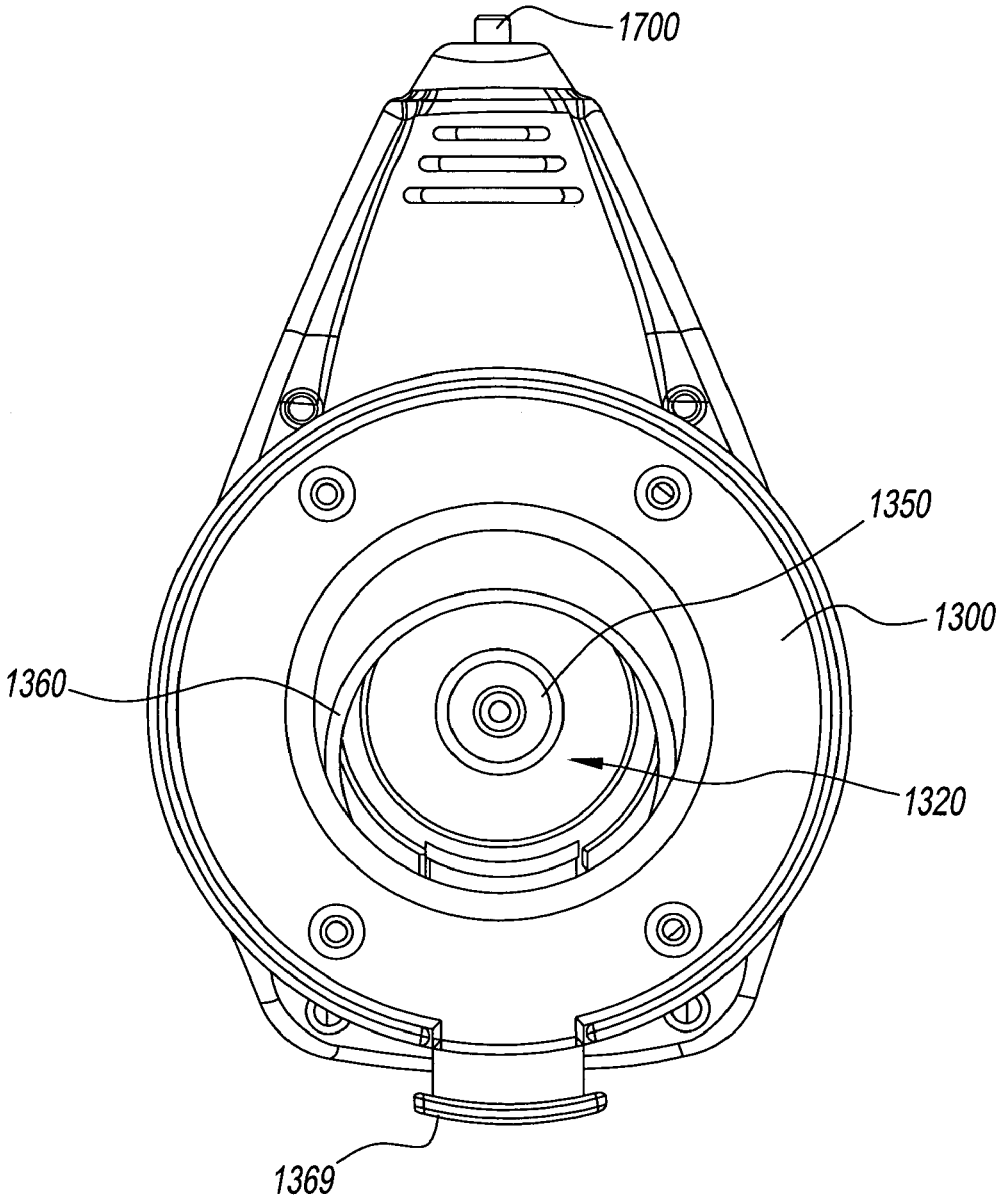
FIG. 11 is a bottom view of the dispenser of FIG. 9.
Figure 12:
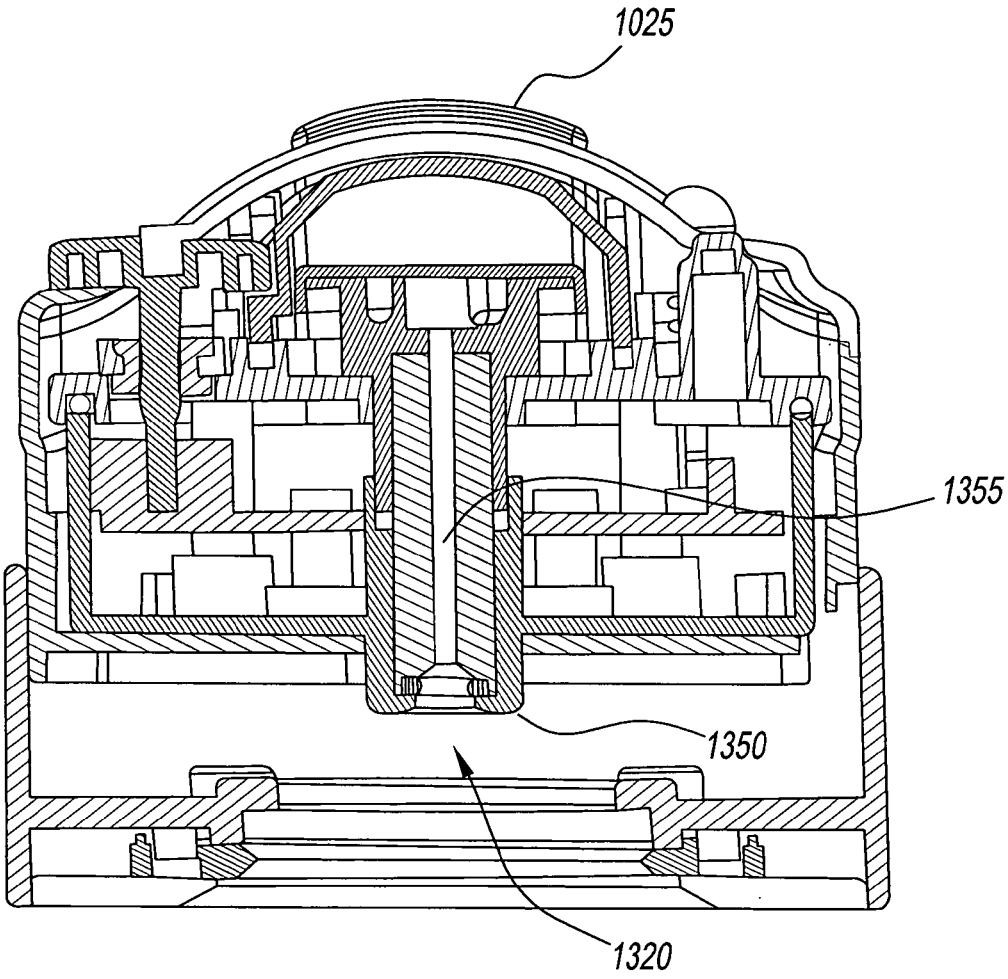
FIG. 12 is a cross-sectional view of the dispenser of FIG. 9, taken along line 12—12 of FIG. 9.
Figure 13:
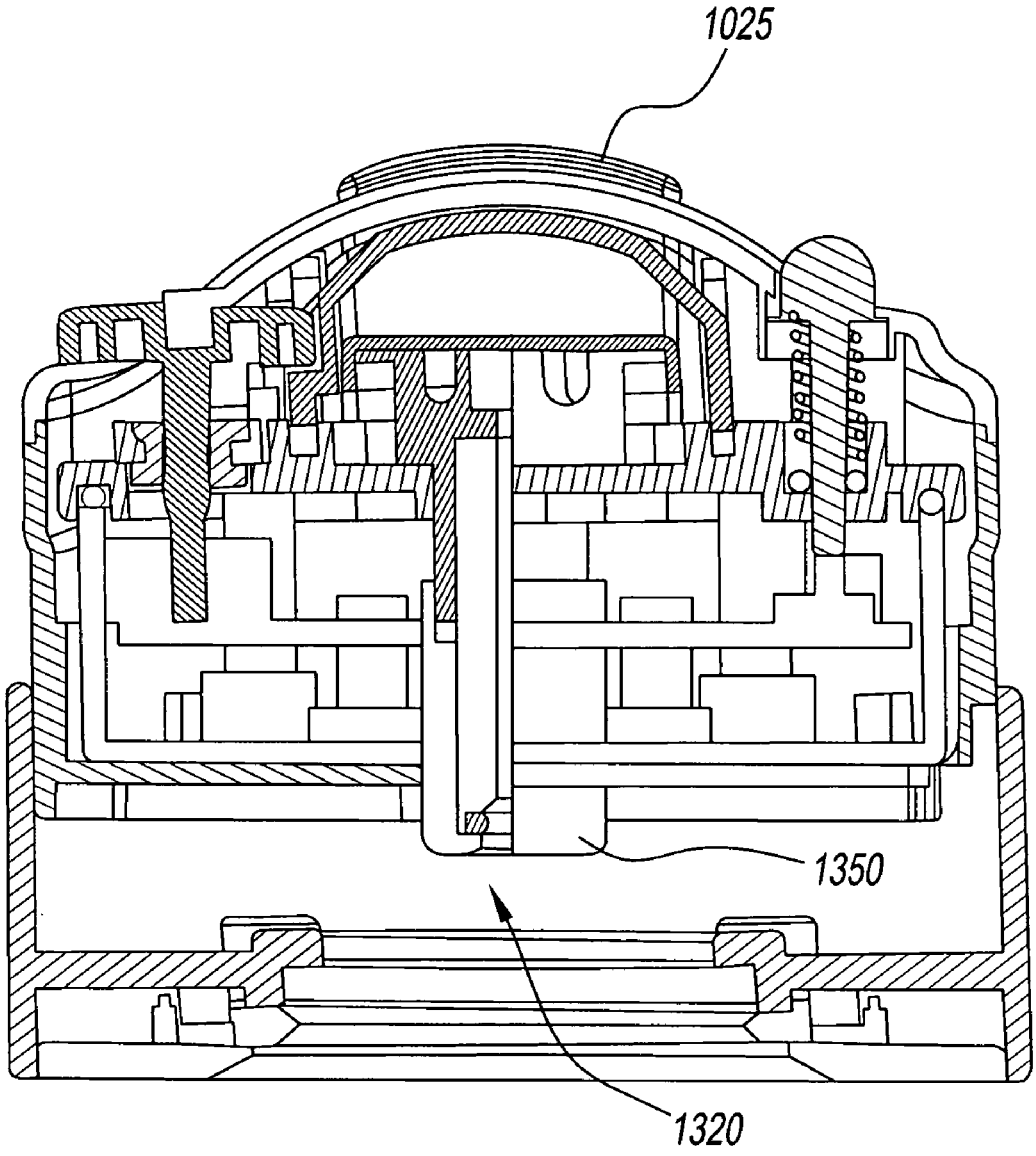
FIG. 13 is a cross-sectional view of the dispenser of FIG. 9, taken along line 13—13 of FIG. 10.
Figure 14:
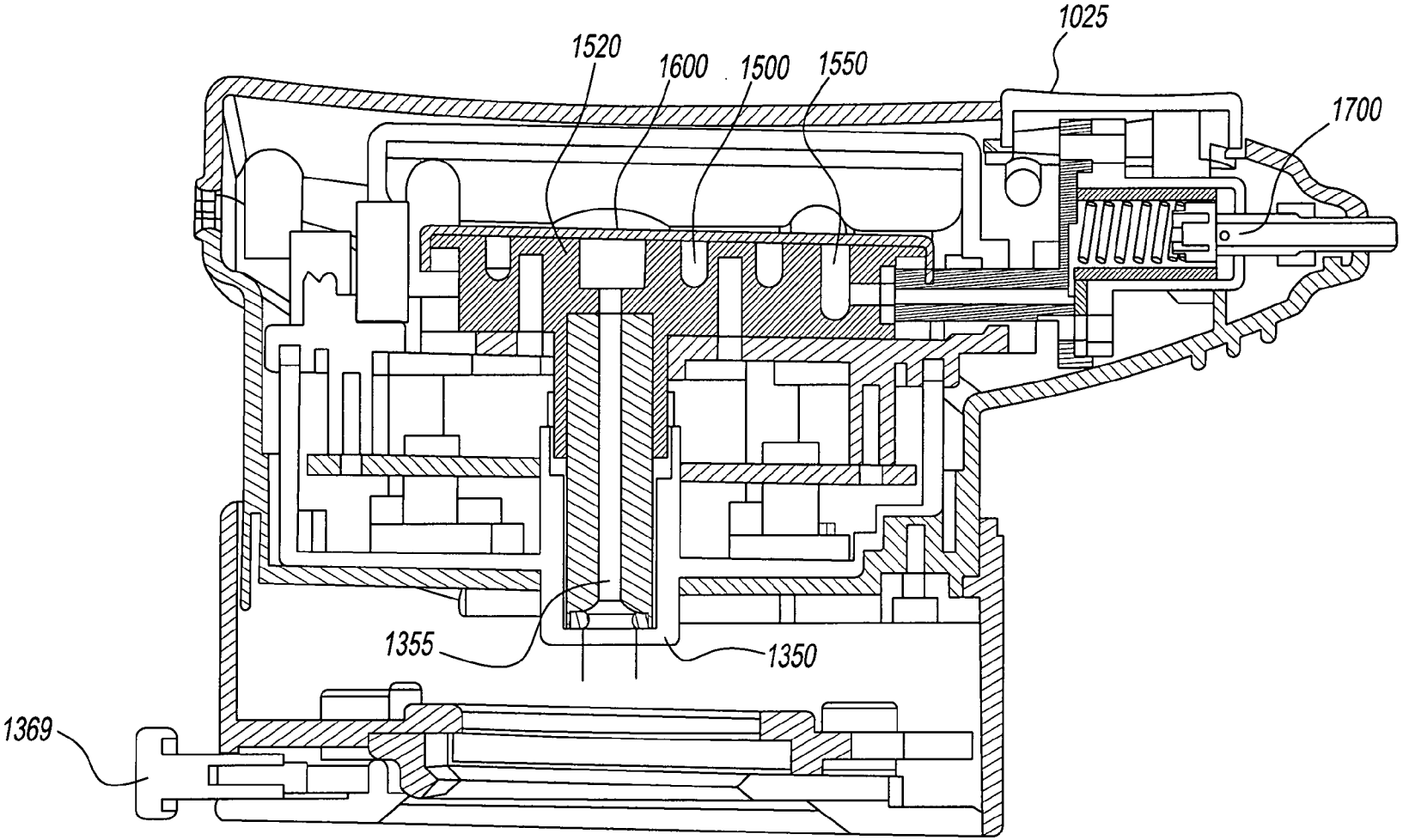
FIG. 14 is a cross-sectional view of the dispenser of FIG. 9, taken along line 14—14 of FIG. 10.
Figure 15:
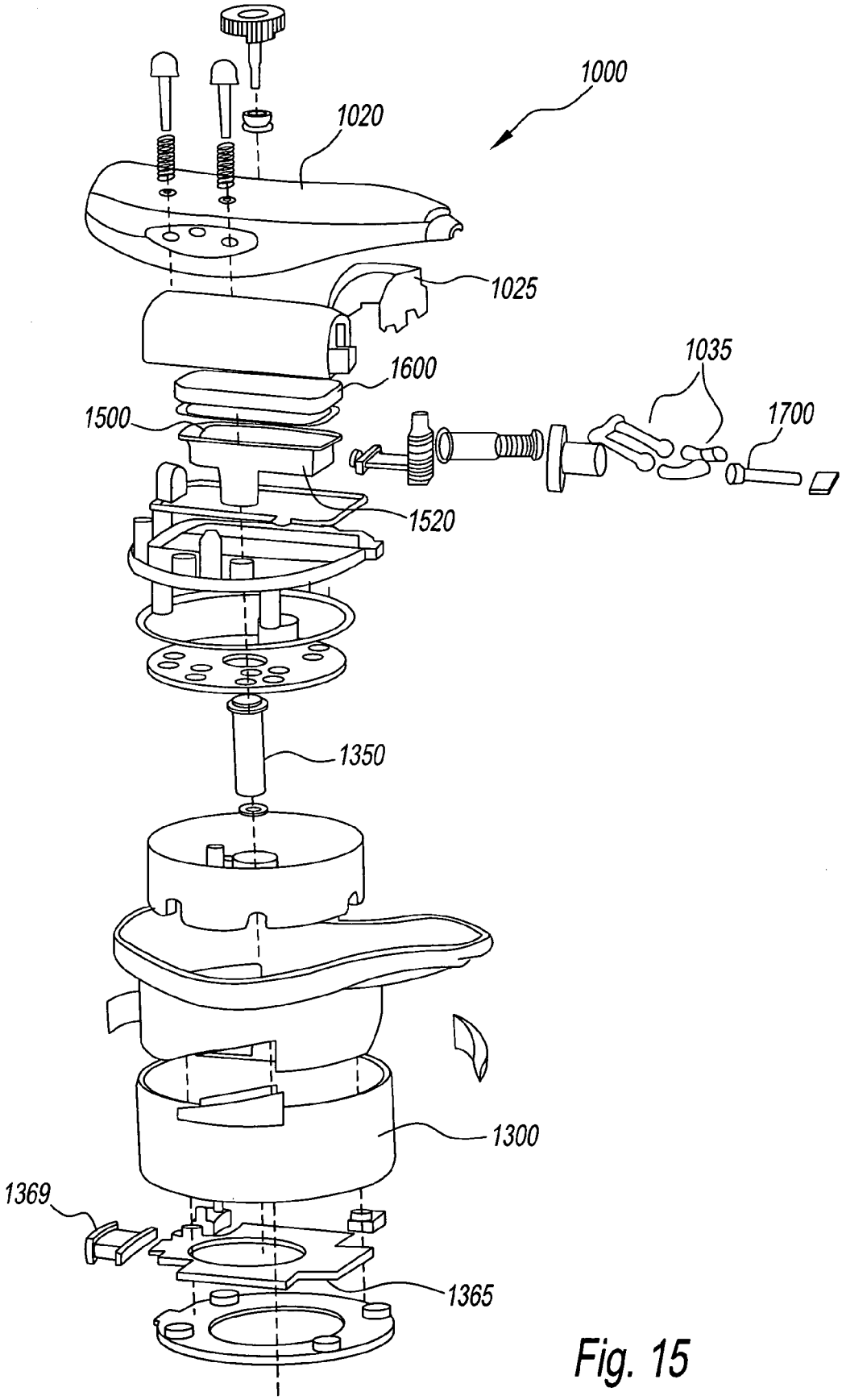
FIG. 15 is an exploded view of the dispenser of FIG. 9.

Referring to FIGS. 9 through 11, an alternative embodiment of the heated dispenser is provided and generally represented by reference numeral 1000. Dispenser 1000 has a top 1020 and a housing 1030. Top 1020 is connected to housing 1030 to allow selective access to the inside of the housing, which contains other components of dispenser 1000. Also shown in FIG. 9, is the top portion of a pressurized gel can 5000. Gel can 5000 has a collar 5100 and a stem 5200 through which the gel is supplied to dispenser 1000.

Referring to FIGS. 9 through 15, housing 1020 has an actuator 1025 that is operably connected to an exhaust valve 1700 by a mechanical linkage 1035 for dispensing of the heated gel. While this embodiment uses a mechanical linkage to actuate exhaust valve 1700, alternative linkage arrangements can also be used.

Housing 1030 has a lower portion 1300 defining a cavity 1320, an intake housing 1350 and a fastening assembly 1360. Cavity 1320 is circular and substantially centrally located in lower portion 1300. Cavity 1320 is preferably dimensioned to fit around collar 5100 of gel-dispensing can 5000 so that stem 5200 of the can be engaged with intake housing 1350. To accommodate for gel cans 5000 having stems 5200 of different length, dispenser 1000 allows for movement of lower portion 1300 with respect to housing 1030. In this embodiment, lower portion 1300 is movably secured to housing 1030 so that a rotation or twisting of the lower portion moves the lower portion downwardly away from the housing, and consequently also moves the intake housing 1350 downwardly away from the housing 1030 and into engagement with stems 5200 that may have different sizes. Lower portion 1300 can be biased so that intake housing 1350 is sealingly engaged with stem 5200 of gel can 5000 to prevent any back flow or leakage of the gel. While a twisting or rotating of lower portion 1300 lowers the intake housing 1350 into proper engagement with the stem 5200 of gel can 5000, other types of movements and mechanisms can also be used to accommodate different sized cans. Also, intake housing 1350 can be made independently movable with respect to housing 1030 or lower portion 1300 for accommodating differently sized stems 5200.

Dispenser 1000 can also have a detent, ratchet or other mechanism (not shown), which provides for one-way movement or rotation of lower portion 1300 while the dispenser is disposed atop of the gel can 5000 in order to further provide for a secure connection between the dispenser and the gel can. The dispenser 1000 is preferably disposed about only the top portion of gel can 5000, as opposed to around a substantial portion of the gel can including the middle and bottom portions, in order to facilitate assembly, to provide better access to the can, to reduce the weight of the assembly, and to reduce cost and difficulty of manufacturing. Top portion 1020 of dispenser 1000 has a size, shape and weight that allows exhaust valve 1700 to extend away from can 5000 to facilitate dispensing and access, while maintaining the stability and balance of the assembly, even when the gel can has dispensed most or all of the gel contained therein. The intake housing 1350 has a channel 1355 that places the heating chamber 1500 in fluid communication with the gel dispensing can 5000 when the dispenser 1000 is disposed on the collar 5100 of the can.

Fastening assembly 1360 has a movable circumferential flange or fastener 1365 positioned along the circumference or outer periphery of cavity 1320. Flange 1365 can be moved by a slide actuator 1369 in order to surround and lock onto collar 5100 of gel can 5000 for a tight and secure fit. Movable flange 1365 provides accommodation for different sized collars 5100 or different sized gel cans 5000 by adjusting the dimensions of cavity 1320 in the area of engagement between dispenser 1000 and the gel can.

Heating chamber 1500 is a channel formed in heat sink 1520. Heating chamber 1500 is in thermal communication with heater 1600. Preferably, heating chamber 1500 is disposed in a first portion of heat sink 1520 in proximity to heater 1600. In this embodiment, the first portion is an upper portion of the heat sink 1520. Heating chamber 1500 can have a serpentine or other non-linear shape, which increases the surface area in thermal contact with the heater 1600, as well as reduces the size of heat sink 1520. Heating chamber 1500 preferably has an inner or maximum volume 1550 that is dimensioned to contain approximately or at least the amount of gel dispensed with a single actuation of actuator 1025. By providing for such a dimension of maximum volume 1550, a user will not dispense a cold shot of gel from outside of heating chamber 1500. Additionally, by heating only the gel that is contained in heating chamber 1500, dispenser 1000 requires less thermal energy and less heat up time. In operation, once dispenser 1000 is secured to gel can 5000, a user selectively depresses actuator 1025 to dispense the gel from heating chamber 1500 through exhaust valve 1700.

It should be understood that the foregoing description is only illustrative of the present invention. Various alternatives and modifications can be devised by those skilled in the art without departing from the present invention. Accordingly, the present invention is intended to embrace all such alternatives, modifications and variances as defined in the appended claims.

What is claimed:

1. An apparatus for heating and dispensing a gel from any one of a plurality of cans having different sized stems, the apparatus comprising:

a housing having a recess therein;

a coupling assembly selectively engageable with each of the plurality of cans for disposing at least a portion of each of the plurality of cans in said recess;

a heater assembly having a heater and a heating chamber in thermal communication with said heater; and an intake assembly in fluid communication with said heating chamber, wherein said intake assembly is selectively movable to engage with the different sized stems of the plurality of cans for supplying the gel to said heating chamber.

2. The apparatus of claim 1, wherein said housing has an upper portion and a lower portion, wherein said recess is formed in said lower portion, and wherein said lower portion is selectively movable with respect to said upper portion.

3. The apparatus of claim 2, wherein said upper portion has a substantially elongated shape and sold lower portion has a substantially circular shape.

4. The apparatus of claim 1, wherein said coupling assembly has a movable fastener that selectively engages with each of the plurality of cans.

5. The apparatus of claim 4, wherein said movable fastener is a circumferential flange disposed about a periphery of said recess.

6. The apparatus of claim 1, wherein said heater assembly further comprises a heat sink, and wherein said heating chamber is formed in said heat sink.

7. The apparatus of claim 6, wherein said heating chamber is a channel having a non-linear shape.

8. The apparatus of claim 6, wherein said heat sink has a first portion, wherein said heater is disposed adjacent to said first portion, and wherein said heating chamber is substantially disposed in said first portion.

9. The apparatus of claim 1, further comprising an actuator and an exhaust valve, said exhaust valve being in selective fluid communication with said heating chamber, wherein depressing said actuator causes gel disposed in said heating chamber to dispense through said exhaust valve.

10. The apparatus of claim 9, wherein said heating chamber has a maximum volume, and wherein actuating said actuator causes a volume of gel substantially equal to said maximum volume to be dispensed through said exhaust valve.

* * * * *